US009556656B2

(12) United States Patent
Machida et al.

(10) Patent No.: US 9,556,656 B2
(45) Date of Patent: Jan. 31, 2017

(54) VEHICLE DOOR LOCK DEVICE

(71) Applicant: AISIN SEIKI KABUSHIKI KAISHA, Kariya-shi (JP)

(72) Inventors: Toshio Machida, Toyota (JP); Shinsuke Takayanagi, Okazaki (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 0 days.

(21) Appl. No.: 14/948,707

(22) Filed: Nov. 23, 2015

(65) Prior Publication Data

US 2016/0145913 A1 May 26, 2016

(30) Foreign Application Priority Data

Nov. 25, 2014 (JP) ..... 2014-238210
Sep. 30, 2015 (JP) ..... 2015-195365

(51) Int. Cl.
*E05C 3/06* (2006.01)
*E05C 3/12* (2006.01)
*E05B 81/06* (2014.01)

(52) U.S. Cl.
CPC ..... *E05C 3/12* (2013.01); *E05B 81/06* (2013.01); *Y10S 292/23* (2013.01); *Y10S 292/37* (2013.01); *Y10T 70/5889* (2015.04)

(58) Field of Classification Search
CPC .. Y10S 292/37; Y10S 292/23; Y10T 70/5889; E05C 3/12
USPC ..... 292/201, DIG. 23
See application file for complete search history.

(56) References Cited

U.S. PATENT DOCUMENTS 8,061,742 B2 11/2011 Machida et al.
8,333,414 B2 12/2012 Takayanagi et al.
2008/0105011 A1* 5/2008 Machida ..... E05B 81/20 70/237
2012/0248796 A1* 10/2012 Kurebayashi ..... E05B 81/20 292/201
2013/0249222 A1* 9/2013 Yokomori ..... E05B 81/38 292/201
2014/0062101 A1* 3/2014 Yokomori ..... E05B 81/04 292/100

(Continued)

FOREIGN PATENT DOCUMENTS

JP 2008-115615 5/2008

*Primary Examiner* — Daniel J Troy
*Assistant Examiner* — Andres Gallego
(74) *Attorney, Agent, or Firm* — Oblon, McClelland, Maier & Neustadt, L.L.P.

(57) ABSTRACT

A vehicle door lock device includes: a latching mechanism maintaining a vehicle door in a closing-stop state; an active lever having a support swiveling around a first support shaft, a link section disposed on the outer side from the support in a radial direction with the first support shaft as the center and having an outer circumferential section linked to and driven by an electric motor, a connection section connecting the support and the link section, and a first engagement section formed in one of an outer circumferential section of the support and an inner circumferential section of the link section; a release lever swiveling around a second support shaft disposed in the recessed portion to be parallel to the first support shaft, interconnected with the latching mechanism, and having a second engagement section engageable with the first engagement section so as to integrally swivel with the active lever.

8 Claims, 7 Drawing Sheets

(56) References Cited

U.S. PATENT DOCUMENTS

2016/0010364 A1* 1/2016 Hanaki ..... E05B 77/54
292/21

* cited by examiner

VEHICLE DOOR LOCK DEVICE

CROSS REFERENCE TO RELATED APPLICATIONS

This application is based on and claims priority under 35 U.S.C. §119 to Japanese Patent Applications 2014-238210 and 2015-195365, filed on Nov. 25, 2014 and Sep. 30, 2015, respectively, the entire contents of which are incorporated herein by reference.

TECHNICAL FIELD

This disclosure relates to a vehicle door lock device.

BACKGROUND DISCUSSION

In the related art, as a vehicle door lock device, a device disclosed in JP 2008-115615A (paragraphs [0049] to [0054] and FIG. 9 to FIG. 11) (Reference 1) is known. The device is configured to include an active lever which is driven to swivel by an electric motor, and a release lever which is interconnected with a latching mechanism and is able to release a vehicle door maintained in a state by the latching mechanism. Also, when the active lever swivels, a pressing section thereof presses a curved contact section of a release input board, and thereby the release input board swivels along with a rotary sliding board. Accordingly, a swivel-connection protrusion of the rotary sliding board presses a protruding contact section of the release lever through a certain free-running zone, and thereby the release lever swivels. The release lever swivels, and thereby the vehicle door maintained in a state by the latching mechanism is released.

Incidentally, Reference 1 discloses a configuration in which swiveling of the active lever is transmitted to the release lever through the release input board and the rotary sliding board, and thereby it is inevitable that the device is increased in size, overall. Therefore, the present applicant has studied a configuration in which the swiveling of the active lever is directly transmitted to the release lever such that the release input board and the rotary sliding board are eliminated. In this case, the release lever may have a curved contact section similar to the release input board and the pressing section of the active lever may press the curved contact section.

However, there is increasing demand for a device that is easily mounted to a vehicle, but on the other hand, there is demand for a device that is decreased in size, overall.

SUMMARY

Thus, a need exists for a vehicle door lock device which is not susceptible to the drawback mentioned above.

A vehicle door lock device according to an aspect of this disclosure includes: a latching mechanism that maintains a vehicle door in a closing-stop state; an active lever that has a support which swivels around a first support shaft, a link section which is disposed on the outer side from the support in a radial direction with the first support shaft as the center and has an outer circumferential section that is linked to and driven by an electric motor, a connection section which connects the support and the link section such that a recessed portion is formed between the support and the link section, and a first engagement section which is formed in one of an outer circumferential section of the support and an inner circumferential section of the link section; a release lever that swivels around a second support shaft which is disposed in the recessed portion to be parallel to the first support shaft, is interconnected with the latching mechanism, and has a second engagement section that is engageable with the first engagement section so as to integrally swivel with the active lever.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

Hereinafter, a first embodiment of a vehicle door lock device will be described. Further, from here on, a frontward and rearward direction of a vehicle is referred to as the "frontward and rearward direction" and upward and downward in a height direction of the vehicle are referred to as "upward" and "downward".

Figure 1:
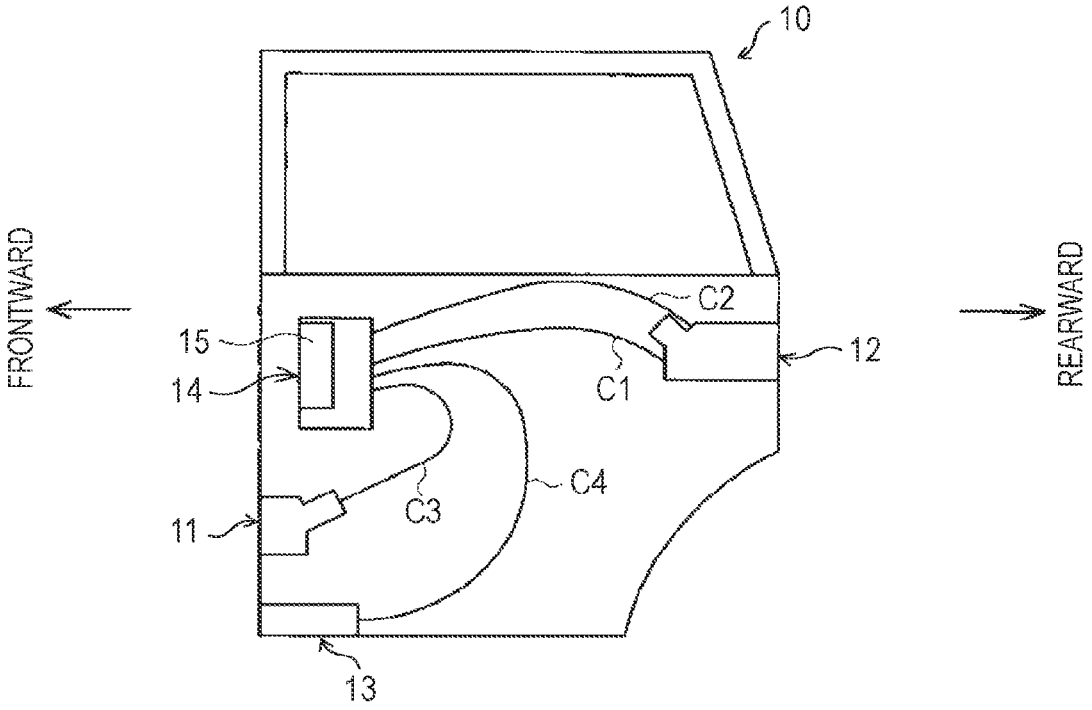
FIG. 1 is a conceptual diagram illustrating a sliding door to which an embodiment disclosed here is applied.

As illustrated in FIG. 1, a sliding door 10 as a door which is appropriately supported in a side section of a body of the vehicle through a support member (not illustrated) closes and opens an opening for entering and exiting the vehicle, which is formed in the body, through movement in the frontward and rearward direction. A completely closed door lock unit 11, the closing/release unit 12, and a full-opening door lock unit 13 are disposed in the sliding door 10. The completely closed door lock unit 11 engages with the body side, thereby maintaining the sliding door 10 in a completely closed state, a closing/release unit 12 maintains the sliding door 10 in the completely closed state or in a half-closed state (closing-stop state), and the full-opening door lock unit 13 engages with the body side, thereby maintaining the sliding door 10 in a full-opening state.

The closing/release unit 12 causes the sliding door 10 in the half-closed state to electrically perform a completely closing operation. In addition, the closing/release unit 12 is mechanically interconnected with a known remote control (remote control) 14 disposed in the sliding door 10 through a release cable C1 and is mechanically interconnected with the remote control 14 through an opening cable C2. The electrically driven closing/release unit 12 generates release-operating power which is transmitted through the release cable C1, the remote control 14, and the opening cable C2, thereby releasing the sliding door 10 maintained in the completely closed state.

Further, the remote control 14 is connected to an operating handle 15 which is exposed on an exterior surface or interior surface of the sliding door 10, the manually driven operating handle 15 generates release-operating power which is transmitted through the opening cable C2, and similarly, the closing/release unit 12 releases the sliding door 10 maintained in the completely closed state.

In addition, the remote control 14 is mechanically interconnected with the completely closed door lock unit 11 and the full-opening door lock unit 13 through the opening cables C3 and C4 and transmits the release-operating power from the electrically driven closing/release unit 12 and the release-operating power from the manually driven operating handle 15 to the completely closed door lock unit 11 and the full-opening door lock unit 13. At this time, the completely closed door lock unit 11 releases the sliding door 10 maintained in the completely closed state or the full-opening door lock unit 13 releases the sliding door 10 maintained in the full-opening state.

Figure 2:
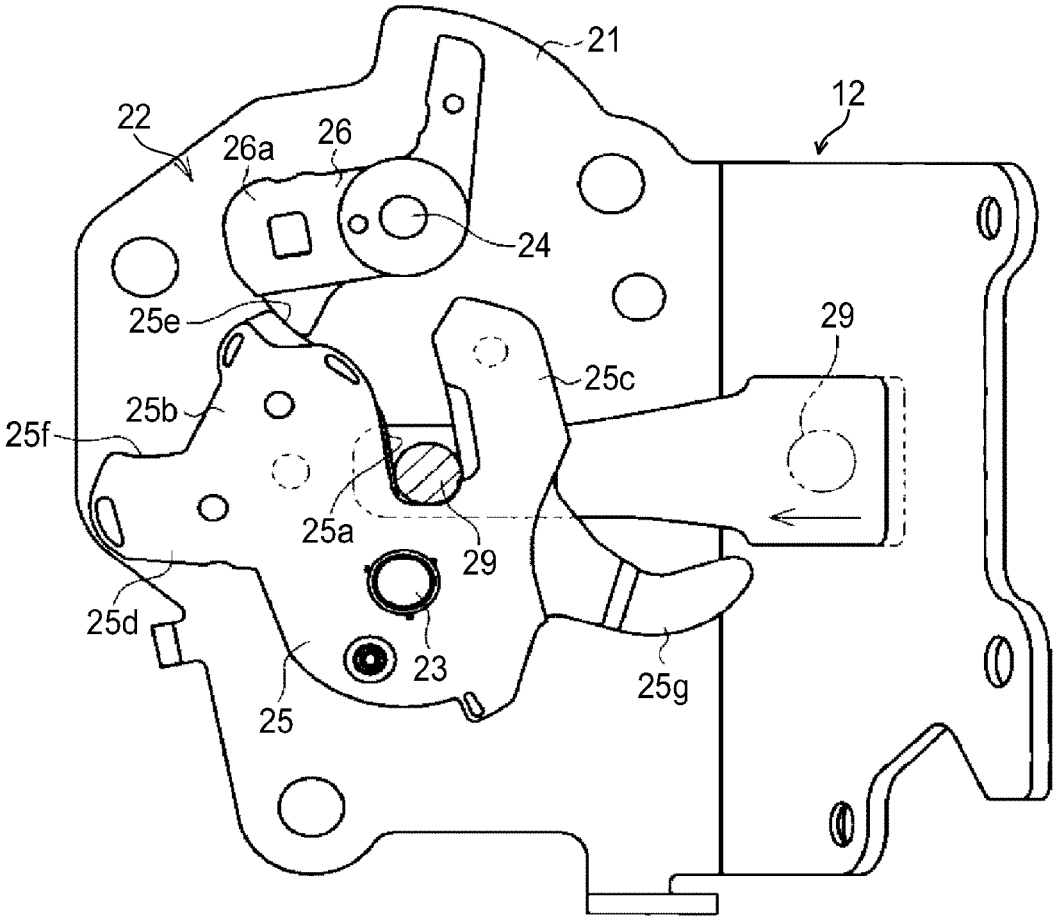
FIG. 2 is a front view illustrating a latching mechanism of a first embodiment disclosed here.

As illustrated in FIG. 2, the closing/release unit 12 has a base plate 21 which is made of a metal plate and is broadened along and fastened to a rear end surface of the sliding door 10 and has a latching mechanism 22 disposed in the base plate 21. The latching mechanism 22 has a latch 25 and pole 26 which are linked to and integrally swivel along with a pair of rotating shafts 23 and 24, respectively, parallel to each other, which are pivotally supported on the base plate 21.

A recessed engagement portion 25*a* having substantially U shape is formed in the latch 25. Also, the latch 25 forms a first claw portion 25*b* and second claw portion 25*c* on one side and the other side (in FIG. 2, sides in a counterclockwise-rotating direction and in a clockwise-rotating direction), respectively, with the recessed engagement portion 25*a* interposed therebetween. In addition, the latch 25 forms a third claw portion 25*d* protruding from an intermediate portion of the first claw portion 25*b* in a longitudinal direction. In a circumferential direction, the end surface of the distal end portion of the first claw portion 25*b*, which faces the second claw portion 25*c* and the end surface of the third claw portion 25*d*, which faces the first claw portion 25*b* forms a fully latched engagement surface 25*e* and a half-latched engagement surface 25*f*, respectively. One end of a latch biasing spring (not illustrated) is hooked to the base plate 21 and the other end thereof is hooked to the latch 25, and thereby the latch is biased on the side on which the latch swivels in the clockwise-rotating direction in the drawing and the latch comes into contact with a latch stopper (not illustrated) disposed in the base plate 21, thereby the swiveling in the corresponding direction is regulated, and the latch is held at a set initial swiveling position (hereinafter, an unlatched position). Further, the latch 25 has an arm-shaped pressed protrusion piece 25*g* which protrudes to the side opposite to the third claw portion 25*d* with the rotating shaft 23 interposed therebetween.

The pole 26 has substantially a claw-like engagement end portion 26*a* extending from the rotating shaft 24 to one side (left side in FIG. 2) in the radial direction. The pole 26 is biased to the side on which a pole biasing spring (not illustrated) causes the pole to swivel in the counterclockwise-rotating direction illustrated in the drawing, that is, the side to which the engagement end portion 26*a* is moved to the lower side in the drawing and the pole is held in the set initial swiveling position.

Here, a basic operation of the latching mechanism 22 is described.

In a state in which the sliding door 10 is opened, the latch 25 held at the unlatched position faces, with the recessed engagement portion 25*a*, a striker 29 firmly fixed to the body. In other words, the recessed engagement portion 25*a* opens an approach path for the striker 29 along with a closing operation of the sliding door 10. In addition, the pole 26 held at the set initial swiveling position causes the engagement end portion 26*a* to be disposed above the third claw portion 25*d*. Further, a state of the latching mechanism 22 at this time is referred to as an unlatched state (release state).

Next, the striker 29 enters the inside of the recessed engagement portion 25*a* along with the closing operation of the sliding door 10. At this time, the striker 29 presses an inner wall surface of the recessed engagement portion 25*a*, the latch 25 swivels in the counterclockwise direction in the drawing against the latch biasing spring, and the engagement end portion 26*a* is latched to the half-latched engagement surface 25*f* and the swiveling is stopped. At this time, the sliding door 10 engages with the striker 29 in the recessed engagement portion 25*a* of the sliding door and enters into the half-closed state in which the engagement is stopped. At this time, the state of the latching mechanism 22 is referred to as a half-latched state and a swiveled position of the latch 25 is referred to as a half-latched position.

Subsequently, the striker 29 enters farther the inside of the recessed engagement portion 25*a* along with another closing operation of the sliding door 10. At this time, the striker 29 presses an inner wall surface of the recessed engagement portion 25*a*, the latch 25 further swivels in the counterclockwise direction in the drawing against the latch biasing spring, and, as shown in FIG. 2, the engagement end portion 26*a* is latched to the fully latched engagement surface 25*e* and the swiveling is stopped. At this time, the sliding door 10 engages with the striker 29 in the recessed engagement portion 25*a* of the sliding door and enters into the completely closed state in which the engagement is fixed. At this time, the state of the latching mechanism 22 is referred to as the fully latched state (engaged state) and a swiveled position of the latch 25 is referred to as a fully latched position.

In addition, in the half-latched state and the fully latched state, when the pole 26 swivels in the clockwise direction in the drawing against the pole biasing spring, the engagement of end portion 26*a* with the half-latched engagement surface 25*f* or the fully latched engagement surface 25*e* is released. At this time, in the latch 25, the striker 29 which is retracted form the inside of the recessed engagement portion 25*a* presses the inner wall surface of the recessed engagement portion 25*a*, along with start of an opening operation of the sliding door 10 due to a repulsive force or the like of a seal member, and thereby the latch 25 moves in the clockwise-rotating direction in the drawing. Also, the sliding door 10 can disengage the striker 29 from the recessed engagement portion 25*a* and can be opened.

Figure 3:
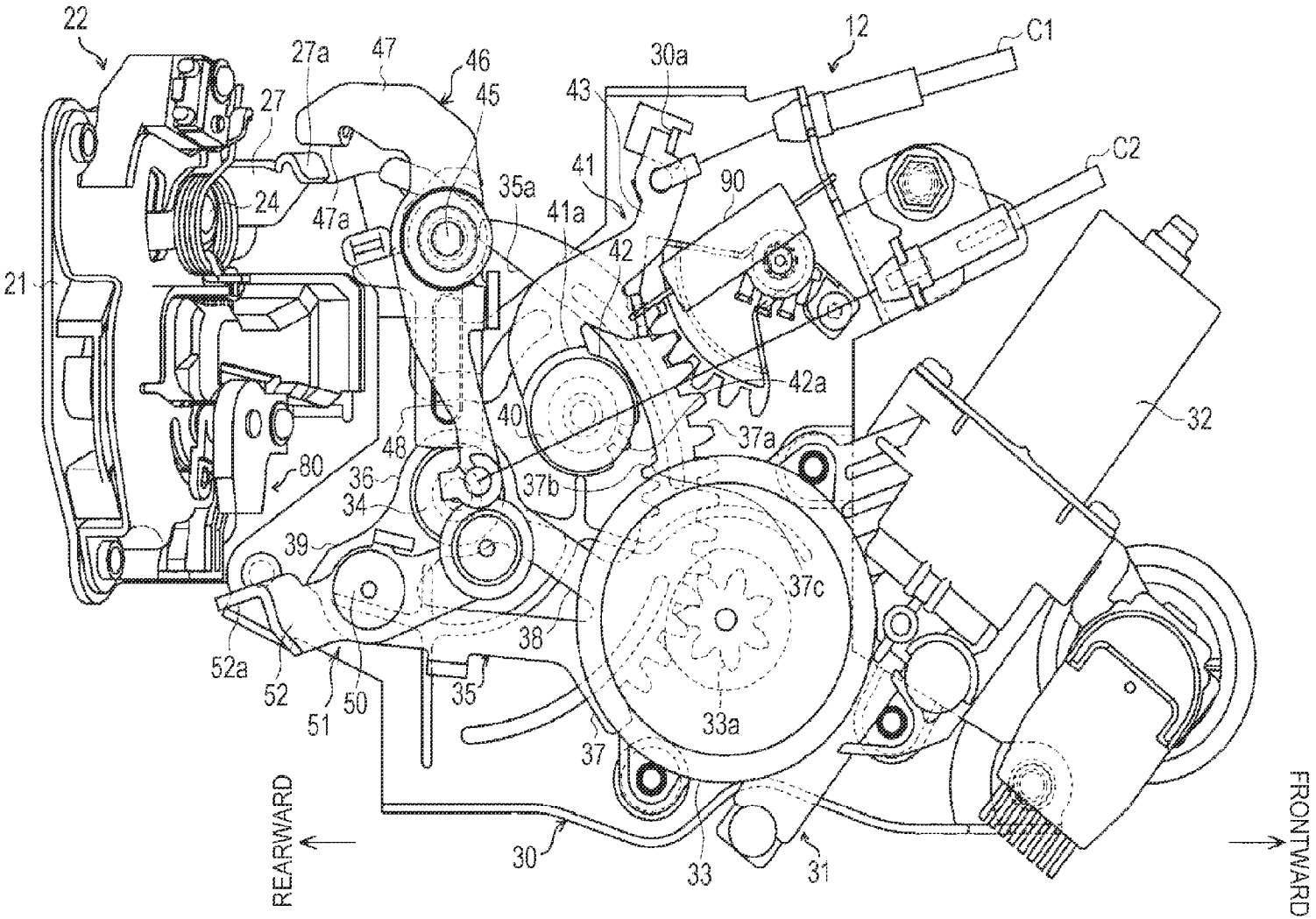
FIG. 3 is a side view illustrating the first embodiment.

Further, as illustrated in FIG. 3, the closing/release unit 12 has a latch switch 80 made of a rotary switch. This latch switch 80 is used for detecting a swiveled position (unlatched position, or the like) of the latch 25. In addition, the closing/release unit 12 has a pole driving lever 27 which is linked to the rotating shaft 24 and the pole driving lever and the rotating shaft integrally swivel. The distal end portion of the pole driving lever 27 is curved to form an upward protrusion and the pressed portion 27*a* is formed. Further, a swiveling direction of the pole driving lever 27, in which the pressed portion 27*a* moves downward matches with the swiveling direction of the pole 26 which releases the engaged state with the latch 25.

A base plate 30 which is broadened frontward of the vehicle and formed of a metal plate is fastened to the base plate 21. The base plate 30 is fastened to the sliding door 10 separately from the base plate 21. An actuator 31 which is driven and controlled by an electronic control unit (ECU) (not illustrated) is disposed frontward in the lower section of the base plate 30. The actuator 31 has an electric motor 32 and a speed reduction mechanism 33 which reduces rotation of the rotating shaft of the electric motor 32. Further, a pinion 33*a* is firmly fixed to an output shaft of the speed reduction mechanism 33.

In addition, a first support pin 34 having substantially a cylindrical shape as a first support shaft, which has its center line extending substantially parallel to the shaft center of the pinion 33*a*, is firmly fixed to the base plate 30 obliquely rearward and upward of the pinion 33*a*. An active lever 35 made of, for example, a metal plate is pivotally supported by the first support pin 34. In other words, the active lever 35 has a substantially circular support 36 through which the first support pin 34 penetrates and which is pivotally supported by the first support pin. In addition, the active lever 35 has a link section 37 having substantially a circular arc shape, which is disposed on the outer side from the support 36 in the radial direction with the first support pin 34 as the center, and the active lever has a connection section 38 which connects an end portion of the link section 37 on one side (side in the clockwise-rotating direction in the drawing) in the circumferential direction with the first support pin 34 as the center and the support 36 in the radial direction with the first support pin 34 as the center. Also, in the active lever 35, the outer circumferential section of the support 36, the inner circumferential section of the link section 37, and a side wall of the connection section 38 form a groove 35*a* having substantially a fan shape as a recessed portion which opens to the other side (side in the counterclockwise-rotating direction in the drawing) in the circumferential direction with the first support pin 34 as the center.

The link section 37 has the outer circumferential section on which a gear unit 37*a* made of a plurality of external teeth is formed and is meshed with the pinion 33*a* of the actuator 31 in the gear unit 37*a*. Accordingly, the pinion 33*a* rotates, and thereby the active lever 35 swivels around the first support pin 34 in a direction in response to the rotation direction. A swiveling position of the active lever 35 in FIG. 3, which meshes with the pinion 33*a* at an intermediate position of the gear unit 37*a* in the circumferential direction is referred to as a "neutral position".

Further, on the inner circumferential section of the link section 37 close to the connection section 38, an internal gear unit 37*b* made of a plurality of internal teeth are formed as a first engagement section and the internal gear. In addition, on the inner circumferential section of the link section 37, a release portion 37*c*, which basically has the same inner diameter as the diameter of the dedendum circle of the internal gear unit 37*b* (internal teeth), and extends in the other side (side in the counterclockwise-rotating direction in the drawing) in the circumferential direction with the first support pin 34 as the center, from the internal gear unit 37*b*, is formed. Further, in the active lever 35, an extension piece 39 extends from the support 36 in the radial direction obliquely rearward and downward with the first support pin 34 as the center. The distal end portion of the extension piece 39 separated from the first support pin 34 turns frontward and is connected to the link section 37 in the vicinity of the connection section 38.

On the base plate 30, a second support pin 40 having substantially stepped cylindrical shape as a second support shaft, which has its center line extending substantially parallel to the center line of the first support pin 34, is firmly fixed in the groove 35*a* of the active lever 35. A release lever 41 made of, for example, a metal plate, is pivotally supported on the second support pin 40. In other words, the release lever 41 has a lever support 42 having substantially a circular shape, through which the second support pin 40 penetrates is pivotally supported by the second support pin. The lever support 42 is also positioned in the groove 35*a* of the active lever 35. The lever support 42 has the outer circumferential section on which a gear unit 42*a* made of the plurality of external teeth as a second engagement section and the external gear are formed at positions which are angled obliquely frontward and downward in FIG. 3, and can mesh with the internal gear unit 37*b* of the active lever 35, in the gear unit 42*a* thereof. It is needless to say that the internal gear unit 37*b* and the gear unit 42*a* are overlapped in at least a part in a range of the plate thickness.

In addition, the release lever 41 has a protruding-lever piece 43 having substantially an arch shape, which extends from the lever support 42 obliquely rearward and upward in the radial direction with the second support pin 40 as the center. Further, in the release lever 41, a step 41*a* having substantially circular arc shape is set on the boundary section between the lever support 42 and the protruding-lever piece 43. The protruding-lever piece 43 is disposed through a step 41*a*, thereby shifted to the front side orthogonal to the paper surface by an amount of the plate thickness of the active lever 35 with respect to the lever support 42, and thus the protruding-lever piece does not interfere with the link section 37 at the intermediate position in the longitudinal direction but passes over the link section.

One end of a bias member 90 is hooked to the base plate 30 and the other end thereof is hooked to the release lever 41, and thereby the release lever is biased on the side on which the latch swivels in the clockwise-rotating direction in the drawing and the release lever comes into contact with a stopper piece 30*a* formed in the base plate 30, thereby the swiveling in the corresponding direction is regulated. At this time, the release lever 41 is held at a set initial swiveling position.

Figure 4:
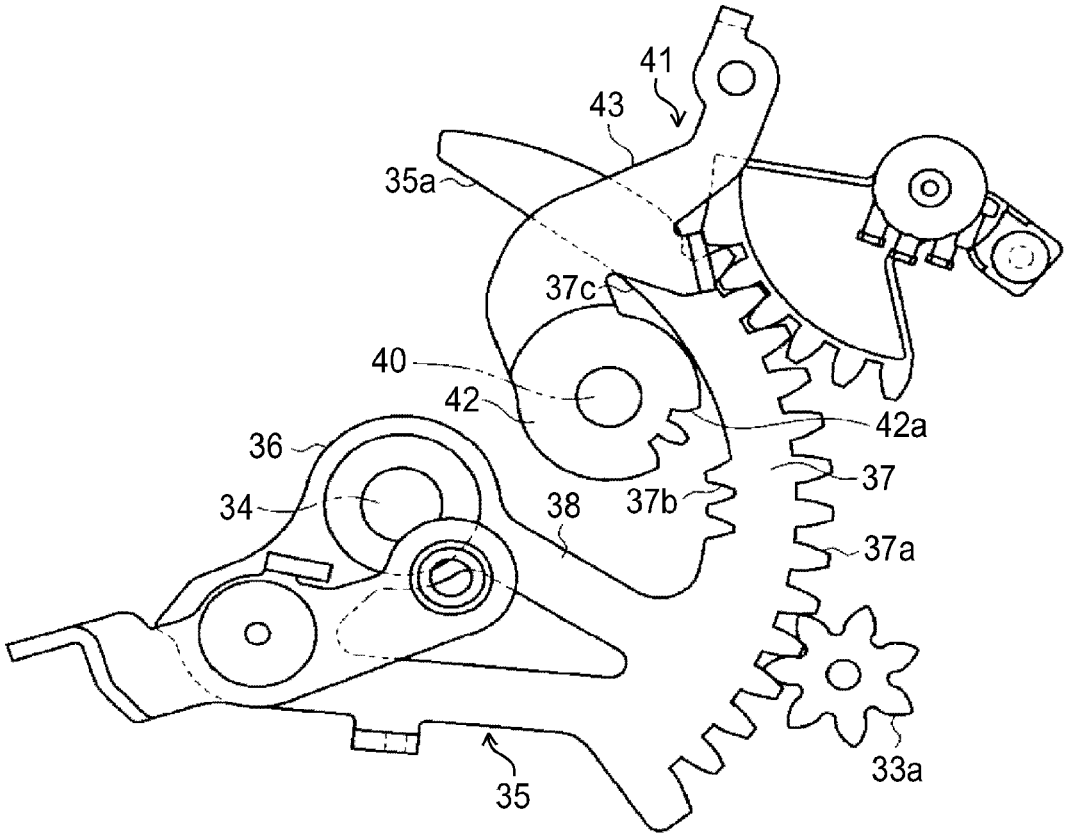
FIG. 4 is a side view illustrating a state in which an active lever is disposed at a neutral position.
Figure 5:
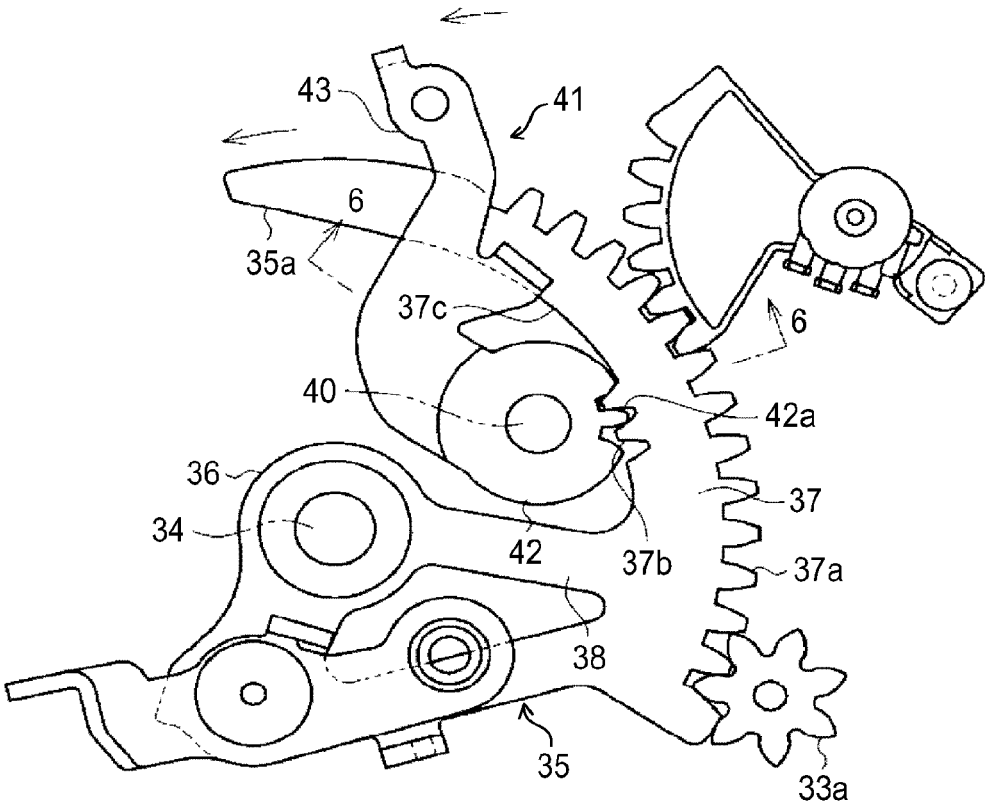
FIG. 5 is a side view illustrating a state in which the active lever swivels from the neutral position.

As also illustrated in FIG. 4, when the release lever 41 is disposed at the initial swiveling position, the release lever 41 has the gear unit 42*a* which advances over and disposed on the side of the internal gear unit 37*b* of the active lever 35, which is the neutral position, in the counterclockwise-rotating direction in the drawing. Also, as illustrated in a change in FIG. 5, when the active lever 35 swivels in the counterclockwise-rotating direction in the drawing, the internal gear unit 37*b* meshes with the gear unit 42*a* through a set free-running zone. The release lever 41 hereby starts to swivel in the counterclockwise-rotating direction in the drawing along with the swiveling of the active lever 35 in the counterclockwise-rotating direction in the drawing against a bias force of the bias member 90. Further, the lever support 42 basically has the same outer diameter as the diameter of the addendum circle of the gear unit 42*a* (external teeth), whereas the release portion 37*c* is formed in the link section 37, and thereby there is no interference therebetween.

Here, second support pin 40 is described.

Figure 6:
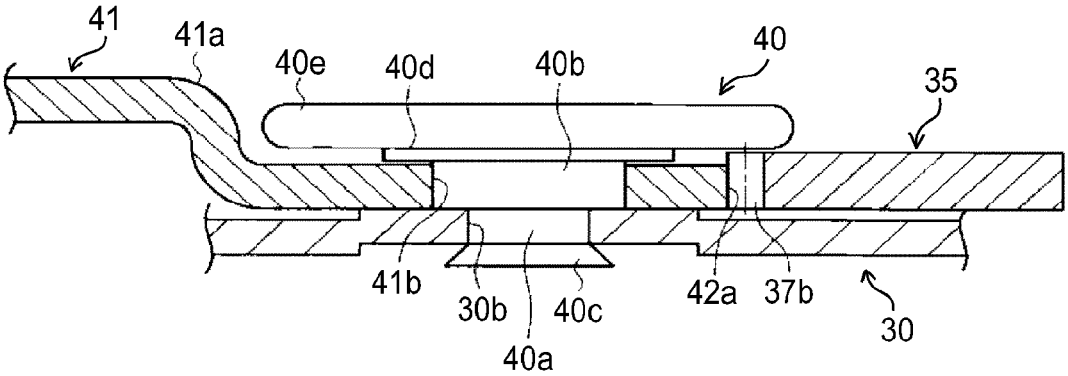
FIG. 6 is a sectional view taken along line 6-6 in FIG. 5.

As illustrated in FIG. 6, on the base plate 30, an attachment hole 30*b* having substantially a circular shape, which is concentric to the second support pin 40, is formed and, on the release lever 41, a support hole 41*b* having substantially a circular shape, which has an inner diameter greater than an inner diameter of the attachment hole 30*b* and is concentric to the attachment hole 30*b*, is formed. In comparison, the second support pin 40 has an attachment section 40*a* having substantially a cylindrical shape which has the same outer diameter as the inner diameter of the attachment hole 30*b* and is pressed into and firmly fixed to the attachment hole 30*b*, and has a support shaft 40*b* having substantially a cylindrical shape, which has the same outer diameter as the inner diameter of the support hole 41*b* and is inserted into the support hole 41*b* to be capable of swiveling. In addition, the second support pin 40 has an escaping-stop portion 40*c* having substantially a truncated cone shape, which is connected to a distal end of the attachment section 40*a* through which the attachment hole 30*b* penetrates, and has a escaping-stop portion 40*d* having substantially a disk shape, which is connected to the support shaft 40*b* which penetrates the support hole 41*b*, and has a diameter greater than the support shaft 40*b*. Further, the support pin 40 has a flange 40*e* having substantially a disk shape, which is connected to the escaping-stop portion 40*d* and has a diameter greater than the escaping-stop portion 40*d*.

Accordingly, the release lever 41 is stopped from escaping in an axial direction in a state in which the circumferential edge portion of the support hole 41*b* is interposed between the base plate 30 and the escaping-stop portion 40*d*. In addition, the outer diameter of the flange 40*e* is set to be overlapped with at least teeth tips of the internal gear unit 37*b* in the radial direction of the flange 40*e* and a meshing position (engagement position of the first engagement section with the second engagement section in an engaged state) of the gear unit 42*a* with the internal gear unit 37*b* is interposed in cooperation with the base plate 30 in the plate-thickness direction.

As illustrated in FIG. 3, in this configuration, a tip of the release cable C1 is hooked to the distal end of the release lever 41 (protruding-lever piece 43). When the release lever 41 swivels from the initial swiveling position, the release cable C1 is configured to be stretched to the closing/release unit 12 side. In other words, the release-operating power from the electrically driven closing/release unit 12 is generated by swiveling the release lever 41 from the initial swiveling position.

A support pin 45 having substantially a cylindrical shape, which has its shaft center extending substantially parallel to the shaft center of the first support pin 34, is firmly fixed to the base plate 30, and an opening lever 46 made of a metal plate is pivotally supported on the support pin 45. In the opening lever 46, a first protruding-lever piece 47 having substantially an arch shape, which extends in the upward radial direction with the support pin 45 as the center and a second protruding-lever piece 48 having an arm shape extends in the downward radial direction with the support pin 45 as the center. Also, the tip of the first protruding-lever piece 47 is curved to form a pressing portion 47*a* which is convex downward above the pressed portion 27*a* of the pole driving lever 27.

In the opening lever 46, a tip of the opening cable C2 is hooked to the distal end of the second protruding-lever piece 48. Accordingly, when the opening cable C2 is stretched to the remote control 14 side, the opening lever 46 swivels around the support pin 45 in the counterclockwise-rotating direction in the drawing. At this time, the pressing portion 47*a* of the opening lever 46 presses the pressed portion 27*a* of the pole driving lever 27 downward, and thereby the pole driving lever 27 swivels such that the pressed portion 27*a* moves downward. The engaged state of the latch 25 with the pole 26 which integrally swivels along with the pole driving lever 27 is released. In other words, the opening cable C2 is stretched to the remote control 14 side, the opening lever 46 swivels, and thereby the release-operating power of the electrically driven closing/release unit 12 and the release-operating power of the manually driven operating handle 15 are transmitted to the closing/release unit 12.

A support pin 50 having substantially a cylindrical shape, which has its shaft center extending substantially parallel to the center line of the first support pin 34, is firmly fixed to the distal end portion of the extension piece 39 of active lever 35 and a closing lever 51 made of, for example, a metal plate is pivotally supported by the support pin 50. The closing lever 51 has a protruding-lever piece 52 extending in the rearward radial direction with the support pin 50 as the center. The tip of the protruding-lever piece 52 forms a pressing-up wall 52*a* having substantially an L shape, to project to the front side orthogonal to the paper surface. The closing lever 51 is held to integrally swivel substantially along with the active lever 35 by an appropriate holding member. When the active lever 35 is disposed at the neutral position, the pressing-up wall 52*a* is disposed below the pressed protrusion piece 25*g* of the latch 25 disposed at the half-latched position. Accordingly, when the active lever 35 and the closing lever 51 swivel in the clockwise-rotating direction in the drawing, the latch 25 in which the pressed protrusion piece 25*g* is pressed by the pressing-up wall 52*a* swivels from the half-latched position to the fully latched position. At this time, as described above, the sliding door 10 in the half-closed state enter into the completely closed state. Further, when the active lever 35 swivels in the clockwise-rotating direction in the drawing, the release portion 37*c* moves the lever support 42, and thereby it is needless to say that the release lever 41 remains at the initial swiveling position.

Next, the operations of the embodiments will be described.

First, the latching mechanism 22 is in the fully latched state or the half latched state and, as illustrated in FIG. 4, the active lever 35 and the release lever 41 are disposed at the neutral position and the initial swiveling position, respectively. In this state, when the actuator 31 is driven by the ECU such that the active lever 35 swivels in the counterclockwise-rotating direction in the drawing, the internal gear unit 37*b* meshes with the gear unit 42*a* of the release lever 41 through a certain free-running zone, and thereby, as illustrated in the change in FIG. 5, the release lever 41 starts to swivel in the counterclockwise-rotating direction in the drawing.

At this time, the release cable C1 stretches to the closing/release unit 12 side and thereby the opening cable C2 stretches to the remote control 14 side using a known function of the remote control 14. The opening lever 46 hereby swivels around the support pin 45 such that the pressing portion 47*a* presses the pressed portion 27*a* of the pole driving lever 27 downward. The pole driving lever 27 and the pole 26 hereby swivels together, and thereby the swiveling-stop of the latch 25 by the pole 26 is released and the sliding door 10 can be released. Further, the latch switch 80 detects that the latch 25 is disposed at an unlatched position, and thereby the drive of the actuator 31 is stopped by the ECU.

Particularly, the release lever 41 is supported to be capable of swiveling around the second support pin 40 disposed in the groove 35*a*, and is capable of meshing with the internal gear unit 37*b* (link section 37) which forms the groove 35*a*, in the gear unit 42*a* thereof. Accordingly, the release lever 41 is disposed in a convergent manner in the vicinity of the first support pin 34.

As described above, according to the embodiment, the following effects are obtained.

(1) In the embodiment, the release lever 41 is supported to swivel around the second support pin 40 disposed in the groove 35*a* and the gear unit 42*a* thereof is engageable with the internal gear unit 37*b* which forms the groove 35*a*. Accordingly, it is possible to dispose the release lever 41 in a convergent manner in the vicinity of the first support pin 34, which enables the device to be further decreased in size, overall.

(2) In the embodiment, the internal gear unit 37*b* is formed on the inner circumferential section of the link section 37 in which it is relatively easy to secure a dimension in the circumferential direction around the first support pin 34, and thereby it is possible to increase a module (size of teeth) of inner teeth of the internal gear unit 37*b* by an amount thereof and it is possible to increase strength of meshing between the internal gear unit 37*b* and the gear unit 42*a*.

(3) In the embodiment, the flange 40*e* interposes the meshing position (engagement position of the first engagement section with the second engagement section in an engaged state) of the gear unit 42*a* with the internal gear unit 37*b* in a meshed state in cooperation with the base plate 30 in the plate-thickness direction. Accordingly, it is possible to suppress a shift (rattle) of the internal gear unit 37*b* (active lever 35) with respect to the gear unit 42*a* (release lever 41) in the plate thickness direction, and it is possible to suppress detachment from the meshing of the internal gear unit 37*b* with the gear unit 42*a*. In this manner, it is possible to more stably maintain the engaged state of the internal gear unit 37*b* with the gear unit 42*a* in cooperation with the base plate 30 and the flange 40*e*. In addition, when the flange 40*e* integrally formed with the second support pin 40 is used, it is possible to suppress the increase in the number of components and the cost, for example, compared to a case where a plate for reducing the shift in the plate-thickness direction is separately provided.

(4) In the embodiment, the transmission of the rotation between the active lever 35 and the release lever 41 is realized by the internal gear unit 37*b* and the gear unit 42*a* which are engageable (capable of meshing) with each other in the range of the plate thickness in which both units are overlapped. Accordingly, similar to a case in which, for example, a flange-shaped pressed portion is provided upright on the release lever in its plate-thickness direction and the rotation is transmitted by pressing the pressed portion by the active lever, the pressed portion may not be curved with respect to the release lever. It is possible to hereby reduce the number of manufacturing processes and a cost thereof.

Otherwise, for example, similar to a case where the pressed portion having a pin shape, which protrudes in the plate-thickness direction of the release lever, is firmly fixed to the release lever, and the rotation is transmitted by pressing the pressed portion against the active lever, the pressed portion may not be provided with respect to the release lever. It is possible to hereby reduce the number of manufacturing processes and a cost thereof.

Since the flange-shaped or pin-shaped pressed portion is not needed to the release lever 41, it is possible to make the release lever 41 thinner. The step 41*a* which enables the protruding-lever piece 43 to extend to the outer side of the active lever 35 (link section 37) is set to the release lever 41. However, since a size for the step 41*a* may correspond to the thickness of the active lever 35, a thinner release lever 41 is still achieved, compared to a case where the flange-shape or pin-shaped pressed portion which needs a dimension greater than the plate thickness of the active lever 35.

Second Embodiment

Hereinafter, a second embodiment of the vehicle door lock device will be described. Further, since the second embodiment has a configuration in which the active lever and the release lever of the first embodiment are modified, detailed description of the same components is omitted.

Figure 8:
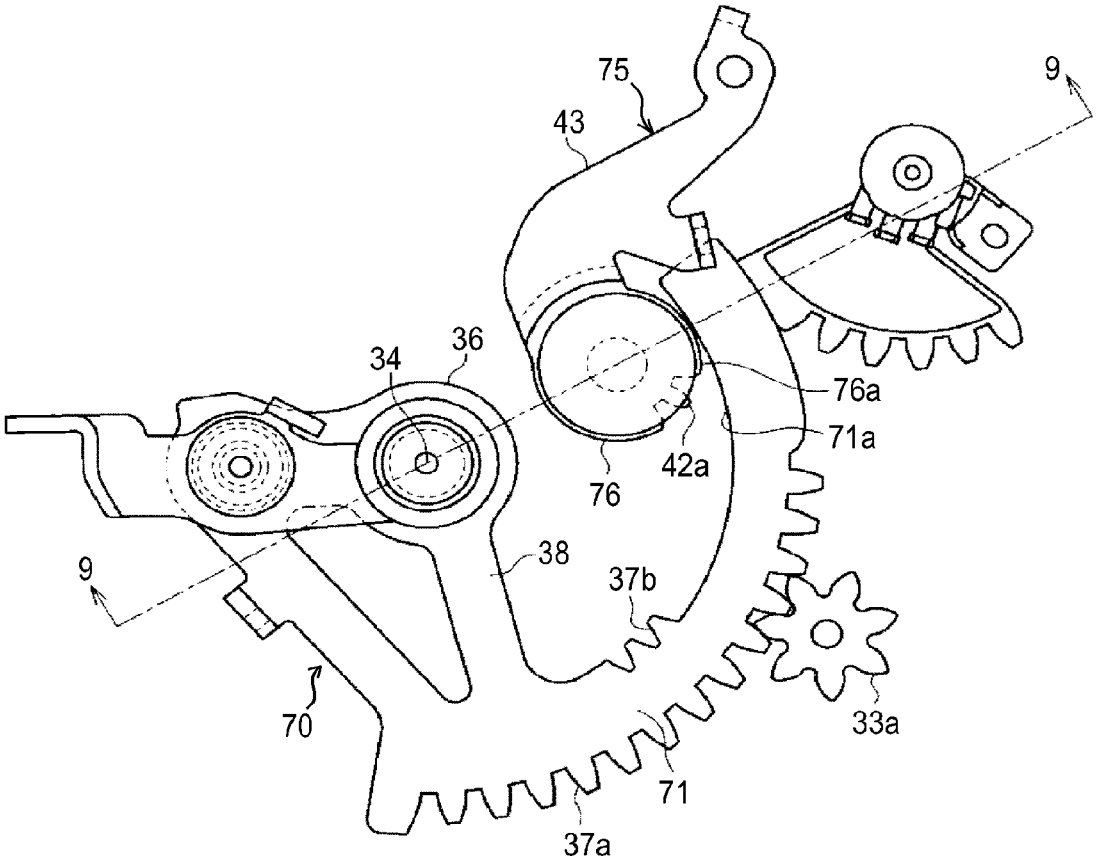
FIG. 8 is a side view illustrating a second embodiment disclosed here.

As illustrated in FIG. 8, the active lever 70 of the embodiment has a link section 71 having a shape corresponding to that of the link section 37. On the inner circumferential section of the link section 71, a first circular arc surface 71*a* as a facing portion, which has the same inner diameter as the diameter of the dedendum circle of the internal gear unit 37*b* (internal teeth) and extends to the other side (side in the counterclockwise-rotating direction in the drawing) in the circumferential direction with the first support pin 34 as the center, from the internal gear unit 37*b*, is formed. In other words, the first circular arc surface 71*a* forms the dedendum circle of the internal gear unit 37*b*.

Meanwhile, the release lever 75 of the embodiment has a lever support 76 having a shape corresponding to that of the lever support 42. On the outer circumferential section of the lever support 76, a second circular arc surface 76*a* which has the same outer diameter as the diameter of the addendum circle of the gear unit 42*a* (external teeth), and extends to the other side (side in the clockwise-rotating direction in the drawing) in the circumferential direction with the second support pin 40 as the center, from the gear unit 42*a*, is formed. In other words, the second circular arc surface 76*a* forms the addendum circle of the gear unit 42*a*.

Next, the operations of the embodiments will be described. Further, as described above, the active lever 70 swivels from the neutral position (refer to FIG. 4) in one direction, and thereby the latching mechanism 22 is operated such that the sliding door 10 in the half-closed state enters into and is maintained in the completely closed state. A swiveled position of the active lever 70 illustrated in FIG. 8 in which the maintaining the sliding door 10 in the completely closed state by the latching mechanism 22 is ended, is referred to as a "fully latched position". In addition, the active lever 70 swivels from the neutral position to the other direction, and thereby the latching mechanism 22 is operated such that the sliding door 10 maintained in the completely closed state is released. A swiveled position (refer to FIG. 5) of the active lever 70 in which the release of the sliding door 10 by the latching mechanism 22 is ended, is referred to as a "release position".

Figure 9:
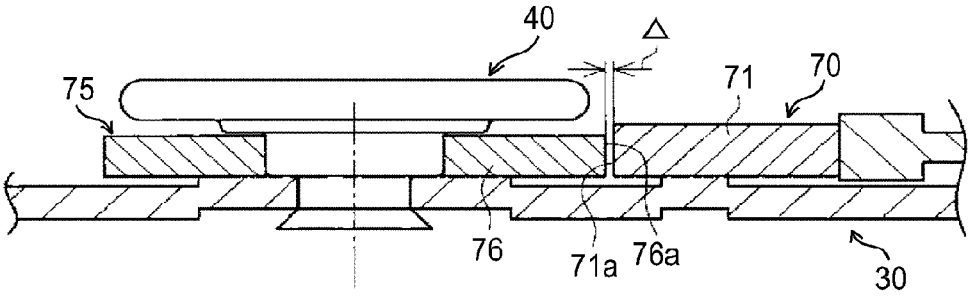
FIG. 9 is a sectional view taken along line 9-9 in FIG. 8.

As illustrated in FIG. 8 and FIG. 9, the first circular arc surface 71*a* approaches the second circular arc surface 76*a* of the lever support 76 at the fully latched position of the active lever 70. More specifically, the first circular arc surface 71*a* approaches the second circular arc surface 76*a* of the lever support 76 over an entire swiveling range of the neutral position and the fully latched position of the active lever 70. A gap Δ between the first and second circular arc surfaces 71*a* and 76*a* matches a gap (so-called top gap) between the addendum circle of the gear unit 42*a* and the addendum circle of the internal gear unit 37*b*. Accordingly, when the active lever 70 swivels from the neutral position to the fully latched position in one direction, the first circular arc surface 71*a* comes into contact with the second circular arc surface 76*a* due to elastic deformation of the link section 71, the active lever 70 receives a load applied from the meshed position (electric motor 32) with the pinion 33*a* while being supported.

As described above, according to the embodiment, the effects described below are obtained in addition to the same effects as in the first embodiment.

(1) In the embodiment, the first circular arc surface 71*a* approaches the second circular arc surface 76*a* of the lever support 76 at least the fully latched position of the active lever 70. Accordingly, when the active lever 70 swivels from the neutral position to the fully latched position in one direction, the first circular arc surface 71*a* comes into contact with the second circular arc surface 76*a* due to elastic deformation of the link section 71, and thereby the active lever 70 receives a load applied from the meshed position (electric motor 32) with the pinion 33*a* while being supported.

(2) In the embodiment, the first circular arc surface 71*a* approaches the second circular arc surface 76*a* of the lever support 76 at least the fully latched position of the active lever 70. Accordingly, when the active lever 70 swivels from the neutral position to the fully latched position in one direction, it is possible to reduce possibility of producing the rubbing noise against the second circular arc surface 76*a*. Or, when the active lever 70 swivels from the neutral position to the fully latched position in one direction, it is possible to reduce possibility that the release lever 75 rotates due to a frictional force produced against the second circular arc surface 76*a*.

(3) In the embodiment, the link section 71 and the lever support 76 approaches each other in the first circular arc surface 71*a* which forms the dedendum circle of the internal gear unit 37*b* and the second circular arc surface 76*a* which forms the addendum circle of the gear unit 42*a*. In other words, the first circular arc surface 71*a* and the second circular arc surface 76*a* are provided in the link section 71 and the lever support 76 respectively, and thereby the surfaces enters into an approaching state naturally. Therefore, it is possible to improve workability.

(4) In the embodiment, at the fully latched position and around thereof at which the large load applied to the active lever 70 from the meshed position (electric motor 32) with the pinion 33*a* in order to slide in the sliding door 10 by the latching mechanism 22, it is possible to receive the load at the state of being supported. Also, the link section 71 is supported by the connection section 38 and the lever support 76 which form a beam shape supported at both ends, and thus, for example, strength at the same degree as a normal sector gear is secured.

Further, the embodiments may be modified as follows.

Figure 7:
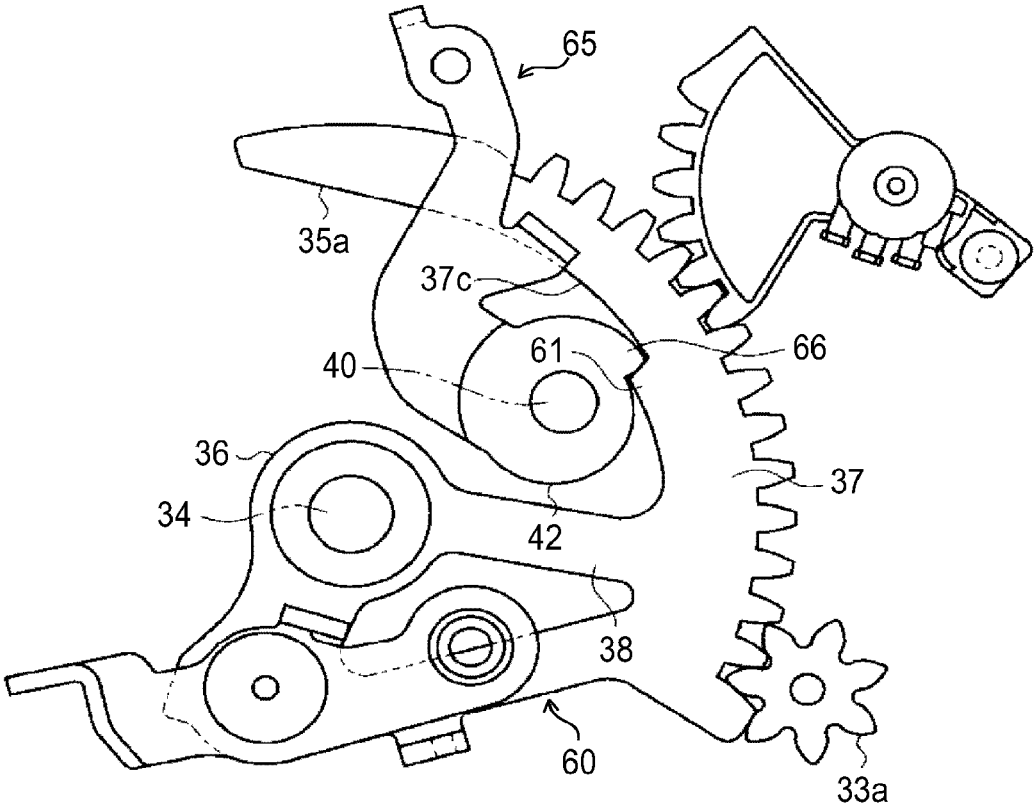
FIG. 7 is a side view illustrating a modified embodiment disclosed here.

As illustrated in FIG. 7, an active lever 60 in which, instead of the internal gear unit 37*b*, a first engagement section 61 having substantially a fan shape, which causes the inner circumferential section of the link section 37, which is close to the connection section 38, to protrude to the first support pin 34 with respect to the release portion 37*c*, may be employed. Also, a release lever 65 in which, the outer circumferential section of the lever support 42, which is close to the connection section 38, is recessed to the second support pin 40 side, and thereby, instead of the gear unit 42*a*, a second engagement section 66 having substantially a fan shape, which causes the outer circumferential section of the lever support 42 on the side separated from the connection section 38, to relatively protrude in the radial direction with the second support pin 40 as the center, may be employed.

When the release lever 65 is disposed at the same initial swiveling position as the release lever 41, the release lever 65 has the second engagement section 66 which advances over and disposed on the side of the first engagement section 61 of the active lever 60, which is disposed at the same neutral position as that of the active lever 35, in the counterclockwise-rotating direction in the drawing. Accordingly, when the active lever 60 swivels in the counterclockwise-rotating direction in the drawing, the first engagement section 61 comes into contact with the second engagement section 66 through the set free-running zone. Also, the end surface of the first engagement section 61, which faces the second engagement section 66 in the circumferential direction, presses the end surface of the second engagement section 66, which faces the first engagement section 61 in the circumferential direction, along with the swiveling of the active lever 60 in the counterclockwise-rotating direction in the drawing, and thereby the release lever 65 starts to swivel in the counterclockwise-rotating direction in the drawing against the bias force of the bias member 90. At this time, the stretching of the release cable C1 to the closing/release unit 12 side is the same as in the embodiment. In such modifications, the same effects (1), (3), and (4), as in the embodiment are obtained.

Further, as illustrated in FIG. 8, the first engagement section 61 may be employed instead of the internal gear unit 37*b* of the link section 71, or the second engagement section 66 may be employed instead of the gear unit 42*a* of the lever support 76. In such modifications, the same effects as in the embodiments disclosed here are obtained.

In the first embodiment, a connection section that connects, in the radial direction with the first support pin 34 as the center, the support 36 and the end portion (side in the counterclockwise-rotating direction in FIG. 3) of the other side in the circumferential direction with the first support pin 34 of the link section 37 as the center, may be employed instead of the connection section 38.

In addition, a connection section that connects, in the radial direction with the first support pin 34 as the center, the support 36 and the end portion (side in the counterclockwise-rotating direction in FIG. 3) of the other side in the circumferential direction with the first support pin 34 of the link section 37 as the center, may be employed in addition to the connection section 38. In other words, an active lever may form a recessed portion having substantially a fan shape by the outer circumferential section of the support 36, the inner circumferential section of the link section 37, and side walls of both connection sections.

In the second embodiment, a gap (Δ) between the facing portion (first circular arc surfaces 71*a*) and the lever support 76 (second circular arc surfaces 76*a*) can be arbitrarily set as long as the gap is within a range of elastic deformation region of the link section 71. In other words, a gap (Δ) between the facing portion (first circular arc surfaces 71*a*) and the lever support 76 (second circular arc surfaces 76*a*) may be set such that the two facing portion comes into contact before plastic deformation of the link section 71.

In the second embodiment, the facing portion (first circular arc surfaces 71*a*) may approach the lever support 76 (second circular arc surfaces 76*a*) at least the fully latched position of the active lever 70. For example, the link section 71 may have a shape concave on the outer circumferential side from the first circular arc surface 71*a* so as to approach the lever support 76 only at the fully latched position of the active lever 70. Or, the link section 71 may be shaped to approach the lever support 76 in a zone from a swiveled position of the active lever 70 which ends the maintaining the sliding door 10 in the half-closed state by the latching mechanism 22 to the fully latched position.

In the second embodiment, the facing portion (first circular arc surfaces 71*a*) may come into contact with the lever support 76 (second circular arc surfaces 76*a*) at least the fully latched position of the active lever 70. For example, the facing portion (first circular arc surfaces 71*a*) may come into contact with the lever support 76 (second circular arc surfaces 76*a*) over the entire swiveling range of the neutral position and the fully latched position of the active lever 70. In these cases, when the active lever 70 swivels from the neutral position to the fully latched position in one direction, for example, it is preferable that the bias force of the bias member 90 is sufficiently secured such that the release lever 75 does not swivel due to the frictional force produced against the second circular arc surface 76*a*. In such modifications, it is possible to always receive the load applied to the active lever 70 from the meshed position (electric motor 32) with the pinion 33*a*.

In the second embodiment, the internal gear unit 37*b* (first engagement section) of the link section 71 and the gear unit 42*a* (a second engagement section) of the lever support 76 may be obviated. In such modifications, the same effects as in the embodiments disclosed here are achieved.

In the respective embodiments, instead of the internal gear unit 37*b* formed in the inner circumferential section of the link section 37, a gear unit having the plurality of external teeth may be formed on the outer circumferential section of the support 36. Also, instead of the gear unit 42*a* engageable with the gear unit, the gear unit may be formed on the release lever 41.

In the respective embodiments, the flange 40*e* of the second support pin 40 may be obviated.

In the respective embodiments, the base plates 21 and 30 may be integrally formed.

In the respective embodiments, the active levers 35 and 70 and the release levers 41 and 75 may have the same thickness or different thicknesses.

In the respective embodiments, a ratio of the speed transmission to the rotation transmission between the active levers 35 and 70 and the release levers 41 and 75 may not be constant. For example, when the release lever swivels to an equivalent amount of swiveling of the pole 26, with which the engagement with the latch 25 can be released, the first engagement section and the second engagement section may engage such that the rotation speed of the release lever becomes slower with respect to the active lever. Or, when the release lever swivels to an equivalent amount of swiveling of the pole 26, with which the engagement with the latch 25 can be released, the first engagement section and the second engagement section may engage such that the swiveling of the release lever stops regardless of the swiveling of the active lever.

In the respective embodiments, for example, when a motor lock (a rapid increase or the like in motor current) is detected in which the pinion 33*a* reaches the terminal end of the gear unit 37*a*, and thereby it is not possible to perform rotation, the driving of the actuator 31, which releases the latching mechanism in the engaged state, may be stopped by the ECU.

The embodiment disclosed here may be employed to, for example, a swing type door or may be applied to a back door disposed rearward in a vehicle.

A vehicle door lock device according to an aspect of this disclosure includes: a latching mechanism that maintains a vehicle door in a closing-stop state; an active lever that has a support which swivels around a first support shaft, a link section which is disposed on the outer side from the support in a radial direction with the first support shaft as the center and has an outer circumferential section that is linked to and driven by an electric motor, a connection section which connects the support and the link section such that a recessed portion is formed between the support and the link section, and a first engagement section which is formed in one of an outer circumferential section of the support and an inner circumferential section of the link section; a release lever that swivels around a second support shaft which is disposed in the recessed portion to be parallel to the first support shaft, is interconnected with the latching mechanism, and has a second engagement section that is engageable with the first engagement section so as to integrally swivel with the active lever.

In this configuration, the release lever is supported to be swivel around the second support shaft disposed in the recessed portion and is engageable with the first engagement section which forms the recessed portion, in the second engagement section thereof. Accordingly, it is possible to dispose the release lever in a convergent manner in the vicinity of the first support shaft, which enables the device to be further decreased in size, overall.

In the vehicle door lock device, it is preferable that the first engagement section and the second engagement section are capable of engaging with each other in a range of a thickness of a plate in which both sections are overlapped.

In the vehicle door lock device, it is preferable that the first engagement section is an internal gear formed on the inner circumferential section of the link section, and second engagement section is an external gear which is capable of meshing with the internal gear.

In this configuration, the internal gear as the first engagement section is formed on the inner circumferential section of the link section in which it is relatively easy to secure a dimension in a circumferential direction around the first support shaft, and thereby it is possible to increase a module (size of teeth) of the inner teeth constituting the internal gear by an amount thereof and it is possible to increase strength of meshing between the internal gear and the external gear.

In the vehicle door lock device, it is preferable that the second support shaft is fixed, in a non-swiveling manner, to a base plate which is fixed to the door and, on the second support shaft, a flange is formed to interpose, in cooperation with the base plate, an engaging position of the first engagement section with the second engagement section in an engaged state, in a plate thickness direction of both sections.

In this configuration, it is possible to suppress a shift in the plate-thickness direction of the first engagement section of the active lever and the second engagement section of the release lever in the engaged state, due to the cooperation of the base plate with the flange. In addition, the flange is integrally formed to the second support shaft, and thereby it is possible to suppress the increase in the number of components.

In the vehicle door lock device, it is preferable that the release lever swivels around the second support shaft in a lever support. It is preferable that the active lever swivels from a neutral position to a fully latched position in one direction, thereby operating the latching mechanism such that the door, which is in a half-closed state, is caused to be maintained in a completely closed state, and the active lever swivels from the neutral position to a release position in the other direction, thereby operating the latching mechanism such that the maintaining of the completely closed state of the door is released by the release lever due to the engagement of the first engagement section with the second engagement section. In addition, it is preferable that the link section has a facing portion which comes into contact with or approaches the lever support at the fully latched position.

In this configuration, the facing portion comes into contact with or approaches the lever support at least at the fully latched position. Accordingly, the facing portion comes into contact with the lever support when the active lever swivels from the neutral position to the fully latched position in one direction, or the facing portion comes into contact with the lever support due to elastic deformation of the link section, and thereby it is possible for the active lever to receive a load applied from the electric motor while being supported.

In the vehicle door lock device, it is preferable that the facing portion approaches the link section at least at the fully latched position.

In this configuration, the facing portion approaches the lever support at least at the fully latched position, and thereby it is possible to reduce possibility of producing rubbing noise with the lever support when the active lever swivels from the neutral position to the fully latched position in one direction.

In the vehicle door lock device, it is preferable that the first engagement section is an internal gear formed on the inner circumferential section of the link section, the second engagement section is an external gear which is formed on an outer circumferential section of the lever support and is capable of meshing with the internal gear, the facing portion is a first circular arc surface which forms the dedendum circle of the internal gear, and the lever support has a second circular arc surface which forms the addendum circle of the external gear and approaches the first circular arc surface.

In this configuration, the first circular arc surface and the second circular arc surface are provided on the link section and the lever support, respectively, and thereby the surfaces enter into an approaching state naturally. Therefore, it is possible to improve workability.

The embodiments disclosed here achieve an effect that it is possible for a device to be decreased in size, overall.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

a latching mechanism configured to maintain a vehicle door in a closing-stop state;

an active lever that has a support which swivels around a first support shaft, a link section which is connected to and disposed outward from the support in a radial direction with the first support shaft as the center and has an outer circumferential section that is linked to and driven by an electric motor, a connection section which connects the support and the link section such that a recessed portion is formed between the support and the link section, and a first engagement section which is formed in one of an outer circumferential section of the support and an inner circumferential section of the link section;

a release lever that swivels around a second support shaft which is disposed in the recessed portion to be parallel and fixed, in a non-swiveling manner, relative to the first support shaft, is interconnected with the latching mechanism, and has a second engagement section that pivots relative to the second support shaft and is engageable with the first engagement section so as to integrally swivel with the active lever.

2. The vehicle door lock device according to claim 1, wherein the release lever swivels around the second support shaft in a lever support, wherein the active lever swivels from a neutral position to a fully latched position in a first direction, and the active lever swivels from the neutral position to a release position in a second direction, and wherein the link section has a facing portion configured to approach the lever support when the active lever swivels to the fully latched position.

3. The vehicle door lock device according to claim 2, wherein the first engagement section is an internal gear formed on the inner circumferential section of the link section, wherein the second engagement section is an external gear which is formed on an outer circumferential section of the lever support and is capable of meshing with the internal gear, wherein the facing portion is a first circular arc surface which forms a dedendum circle of the internal gear, and wherein the lever support has a second circular arc surface which forms an addendum circle of the external gear and approaches the first circular arc surface.

4. The vehicle door lock device according to claim 1, wherein the first engagement section and the second engagement section are engageable with each other in a range of a thickness of a plate in which both sections are overlapped.

5. The vehicle door lock device according to claim 1, wherein the first engagement section is an internal gear formed on the inner circumferential section of the link section, and wherein the second engagement section is an external gear which is capable of meshing with the internal gear.

6. The vehicle door lock device according to claim 1, wherein the second support shaft is fixed, in a non-swiveling manner, to a base plate and, wherein, on the second support shaft, a flange is formed to interpose, in cooperation with the base plate, an engaging position of the first engagement section with the second engagement section in an engaged state, in a plate thickness direction of both sections.

7. The vehicle door lock device according to claim 1, wherein the release lever swivels around the second support shaft in a lever support, wherein the active lever swivels from a neutral position to a fully latched position in a first direction, and the active lever swivels from the neutral position to a release position in a second direction, and wherein the link section has a facing portion which comes into contact with the lever support at the fully latched position.

8. The vehicle door lock device according to claim 1, wherein the release lever includes a lever piece distal from the second engagement section, the lever piece configured to be attached to a release cable to move the release lever.

* * * * *